US006746575B1

(12) United States Patent
Juvakka et al.

(10) Patent No.: US 6,746,575 B1
(45) Date of Patent: Jun. 8, 2004

(54) DOCTOR FOR A SUCTION ROLL PARTICULARLY IN PAPER MACHINES

(75) Inventors: Tuomo Juvakka, Haapaniemi (FI); Jouko Pussinen, Anjalankoski (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/831,390

(22) PCT Filed: Nov. 12, 1999

(86) PCT No.: PCT/FI99/00939

§ 371 (c)(1),
(2), (4) Date: May 3, 2001

(87) PCT Pub. No.: WO00/29669

PCT Pub. Date: May 25, 2000

(30) Foreign Application Priority Data

Nov. 16, 1998 (FI) ..... 980495 U

(51) Int. Cl.[7] ..... D21G 3/00; D21F 7/00

(52) U.S. Cl. ..... 162/272; 162/274; 162/281; 162/282; 15/256.51

(58) Field of Search ..... 162/272, 274–282, 162/199, 367, 373; 15/256.5, 256.51; 100/174; 118/413, 261; 101/425, 157, 169; 198/499; 427/356; 399/283, 284

(56) References Cited

U.S. PATENT DOCUMENTS

| | | | | |
|---|---|---|---|---|
| 3,198,693 A | | 8/1965 | Justus | 162/358.1 |
| 5,021,124 A | | 6/1991 | Turtinen | 162/281 |
| 5,032,229 A | * | 7/1991 | Boucher | 162/2.81 |
| 5,178,731 A | | 1/1993 | Kivimaa | 162/199 |

FOREIGN PATENT DOCUMENTS

| | | |
|---|---|---|
| EP | 0117670 | 5/1984 |
| WO | 9827279 | 6/1998 |

OTHER PUBLICATIONS

Tuomo Juvakka and Mikko Viljamaa, CombiDoc from Fiber & Paper, vol. 3, Issue 1, 2001, p. 25.

* cited by examiner

*Primary Examiner*—Steven P. Griffin
*Assistant Examiner*—Eric Hug
(74) *Attorney, Agent, or Firm*—Fildes & Outland, P.C.

(57) ABSTRACT

A doctor for a suction roll in a paper machine is intended to remove water from a suction roll. The doctor includes a doctor slat fitted against the surface of suction roll extending essentially over the entire width of the suction roll, as well as the doctor slat holder and loading devices. In the direction of rotation of the suction roll, there is a doctor blade, with a blade holder fitted to the doctor after the doctor slat. The doctor blade is arranged to remove the water lifted off the suction roll by the doctor slat.

4 Claims, 2 Drawing Sheets

DOCTOR FOR A SUCTION ROLL PARTICULARLY IN PAPER MACHINES

TECHNICAL FIELD

The present invention relates to a doctor for a suction roll particularly in paper machines, which doctor is intended to remove water from the suction roll, and which doctor includes a doctor slat arranged against the surface of the suction roll and essentially extending over the entire length of the suction roll, together with the doctor slat's retaining and loading members.

BACKGROUND OF THE INVENTION

A suction roll doctor, which removes water from the suction roll, is known from FI patent application number 902910. The blade used in the doctor is a doctor slat, which scrapes the film of water off the surface of the suction roll. In addition, the doctor slat creates a suction zone behind itself, which also removes the water that has collected in the drill holes and grooves of the suction roll. Part of the water raised by as the suction flows into a drainage tank beneath the suction roll, but the rotation of the suction roll causes part of the moisture to travel back into the felt or similar. This causes the web or felt to become soaked, or at least causes unevenness in the moisture profile of the web, felt, or paper.

A double doctor, in which an attempt has been made to improve the water removal capacity of the doctor by using two doctor blades, has also been manufactured for similar use. However, a conventional doctor blade cannot be used to achieve the suction effect of a doctor slat according to the invention, which can also suck the water out of the holes of the suction roll. In addition, doctor blades operate in the desired manner only over a certain part of the circumferential speed range of the suction roll. In this case, when the speed of the paper machine increases, both the water removal capacity of the doctor in question and the result of the doctoring diminish substantially.

SUMMARY OF THE INVENTION

The invention is intended to create a new kind of doctor for a suction roll particularly in paper machines, by means of which water can be removed from the suction roll more effectively than previously.

A doctor for removing water from a suction roll in a paper machine includes a doctor slat fitted against the surface of the suction roll extending essentially over the entire width of the suction roll, as well as its holder and loading devices. In the direction of the rotation of the suction roll, there is a doctor blade and a blade holder fitted to the doctor after the doctor slat and arranged to remove the water lifted off the suction roll by the doctor slat. The angle between the lines of contact of the doctor slat and the doctor blade in relation to the imagined axis of rotation of the suction roll is 15–70°, preferably 20–40°.

The doctor has a frame construction, to which holders of both the doctor slat and the doctor blade are fitted. The holder of the doctor slat is fitted detachably to the frame construction. The frame construction includes attachments corresponding to the blade holder of the doctor blade in the vicinity of the holder of the doctor slat.

The combination construction of a doctor according to the invention actualizes the advantageous properties of the doctor, in practice creating an excellent doctoring result.

Simultaneously, a significant increase in the total solids content is achieved. Besides water, fibres and filler substances are also removed from the holes in the suction roll. This reduces the amount of loose material rotating with the suction roll and also helps the suction roll's holes to remain clean. The doctor also evens the humidity in the area around the suction roll, as most of the water is recovered in a controlled manner. Thus, the web, felt, or similar do not become soaked, instead an even moisture profile is maintained. A doctor according to the invention can be used in all suction roll positions. In addition, only small alterations are required to adapt the doctor to a very broad area of the auction roll's speed range.

In the following, the invention is described in detail with reference to the accompanying drawings, depicting some embodiments of the invention, in which drawings

BRIEF DESCRIPTION OF THE DRAWINGS

The doctor according to the invention, shown in FIG. 1, has two blades 12 and 13, which are fitted to the frame construction 11 of the doctor 10. Frame construction 11 is compact and is supported at both ends on bearings attached to the frame of the paper machine by means of adjustable supports 14. The frame is shown by a dotted line. If necessary, doctor 10 can be turned away from the surface of the suction roll 15 by means of a turnbuckle 16 or similar. In FIG. 1, turnbuckle 16 is fitted between a fixed bracket 17 and a supporting arm 18 attached to the turning frame construction 11. However, turnbuckle 16 is mainly only used to adjust the position of the doctor 10. Blades 12 and 13 are loaded and released by means of holders 20 and 21, which are equipped with conventional loading hoses 19 and 19'.

Figure 1:
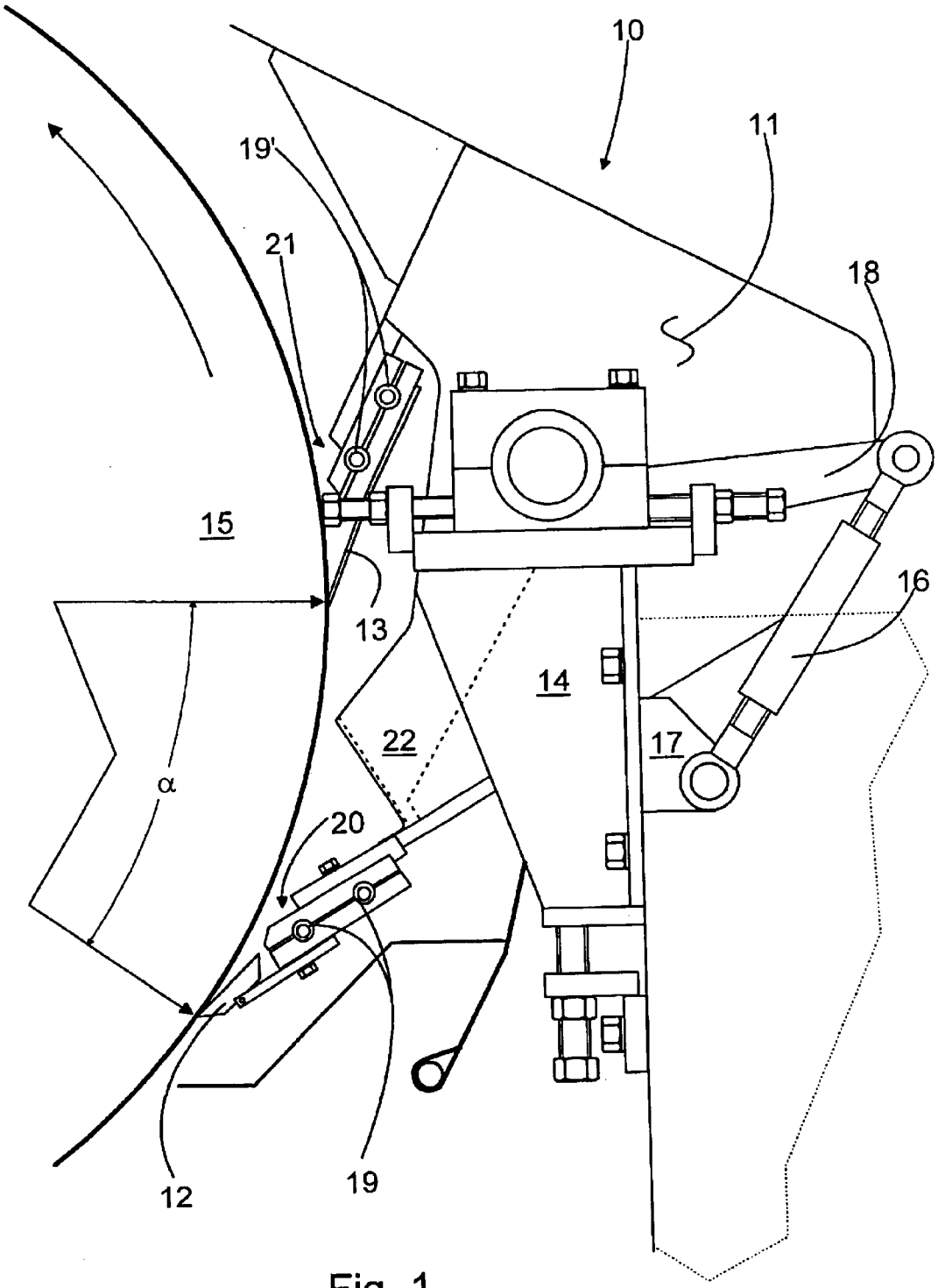
FIG. 1 shows side view of a doctor according to the invention.

In the operating position in FIG. 1, blades 12 and 13 in doctor 10 act against the surface of suction roll 15, the actual suction sector being on the opposite side of suction roll 15. Suction roll 15, the holes or grooves in which are not shown in the drawing, rotates in the direction shown by the arrow. The water removed by the first blade 12 in the direction of rotation of suction roll 15 is collected in a drainage tank beneath suction roll 15. The water collected by the second blade 13 is led to a trough 22 formed in the frame construction 11, where it does not interfere with the operation of the first blade 12. The water is then led from trough 22 to the drainage tank beneath suction roll 15.

DETAILED DESCRIPTION OF THE INVENTION

According to the invention, a doctor blade 13, which is as such known, is fitted to the doctor 10, behind the first blade 12, which in this case is a doctor slat, in the direction of rotation of suction roll 15. In the example, doctor blade 13 also includes a conventional blade holder 21 and loading hoses 19'. This blade combination gives a better doctoring result than previously, especially when the circumferential speed of the suction roll is sufficiently high. In practice, the doctor slat 12 first removes the film of water from the suction roll 15 and then creates a suction effect after it. This so-called foil effect always arises when a suction roll rotates, but, as is known, significant suction is only created once the circumferential speed of the suction roll rises to a certain level. From this level onwards, the suction effect will usually increase, or at least remain the same. The foil effect sucks the water from the holes in the suction roll, which is then removed to trough 22 by doctor blade 13. Fibres and binders also rise from the holes along with the water and are removed by doctor blade 13. A doctor according to the invention is so effective that the excess moisture does not rotate with the suction roll. Thus, the suction roll also functions more efficiently and re-wetting of the web or felt is eliminated.

Both doctor slat 12 and doctor blade 13 holders 20 and 21 are attached to the frame construction 11 of the doctor, allowing both blades 12 and 13 to be adjusted simultaneously in the doctor 10 installation. In addition, holders 20 and 21 are adapted to the frame construction 11 in such a way that the angle $\alpha$ between the lines of contact of doctor slat 12 and doctor blade 13 in relation to the imagined axis of rotation of suction roll 15 is 15–70°. Preferably, angle $\alpha$ is 20–400°. Doctor blade 13 will then be able to move under the film of water raised by doctor slat 12 and the water will not have time to be sucked back into the holes. In addition, thanks to blades 12 and 13 being set close to each other, the size of doctor 10 remains small. The doctor slat is preferably made from plastic.

The holder 20 of doctor slat 12 is arranged to be attached to the frame construction 11 of doctor 10 in such a way that it can be detached. In addition, frame construction 11 includes attachment devices (not shown), corresponding to blade holder 21 of doctor blade 13, in the vicinity of holder 20 of doctor slat 12. Thus, the same doctor can also be used in paper machines that are classified as slow. In this case, it is justified to install a doctor according to the invention, equipped with a conventional doctor blade, in a paper machine, even though the machine is of a so-called slow type. This allows the doctor to be rebuilt simply in future speed-raising projects, by replacing the normal blade, which has acted as the first blade, with a doctor slat. The speed limit at which replacement is justified must be determined for individual cases. In principle, the suction effect of the doctor slat becomes significant, once the circumferential speed of the suction roll becomes sufficiently great.

Figure 2:
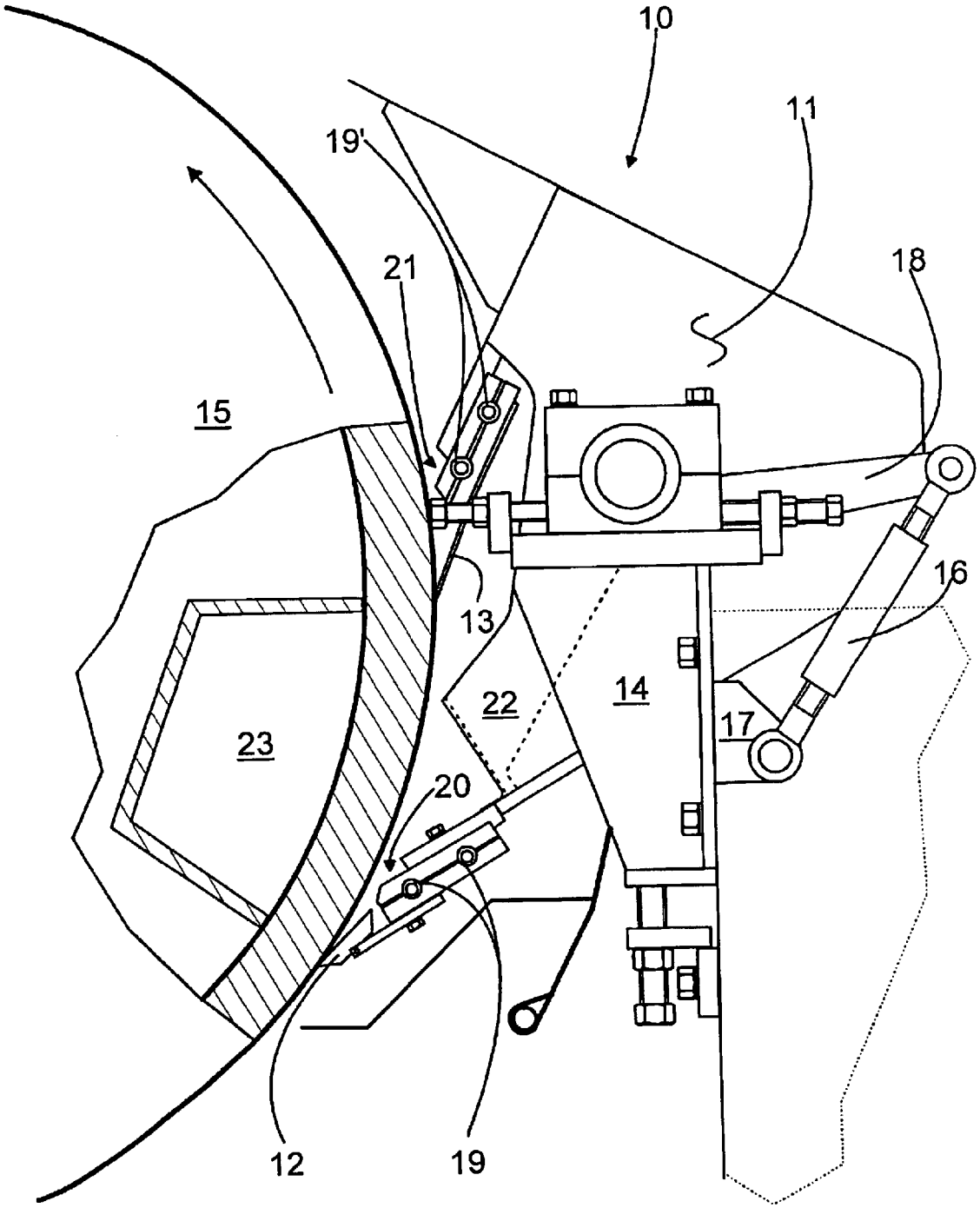
FIG. 2 shows a side view of a doctor according to the invention, as part of an arrangement for removing water, fitted to a suction roll.

To further improve the operation of the suction roll, it is preferable to arrange a doctor according to the invention as part of the arrangement shown in FIG. 2. The same reference numbers are used for the functioning parts. The arrangement according to FIG. 2 includes positive-pressure chamber 23, in which is fitted inside suction roll 15 in the area of the doctor 10. Preferably, the positive-pressure chamber 23 is located between blades 12 and 13, immediately after blade 12 in the direction of rotation. The water-removing effect of the vacuum formed by doctor slat 12 is then reinforced by the positive pressure discharging from the holes. Positive-pressure chamber 23 terminates before the second blade, so that the operation of doctor blade 13 is not disturbed by the flow of air. The arrangement empties the holes of the suction roll more efficiently than before.

A suction roll doctor according to the invention can therefore be applied over a broad range of the circumferential speed of a suction roll, in all suction roll positions. In particular, the replacement of the doctor for different speed ranges is simple, which reduces costs. In practice, a significant increase in total solids content is achieved by using the doctor. When the doctoring result is good, the moisture profile after the suction roll is also more even, because the water that has once been sucked from the web or felt does not return to the web or felt. In this case, the veil of moisture surrounding the suction roll also becomes thinner.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A doctoring device adapted for use with a paper machine suction roll having a suction roll axis of rotation, said doctoring device comprising:

a doctor blade holder;

a doctor blade fixed on said blade holder, said doctor blade having an edge against said suction roll and contacting said suction roll at an angle disposed relative to a tangent of said suction roll at the point of contact;

a doctor slat holder;

a doctor slat connected to said slat holder, said doctor slat having an edge in urged engagement with said suction roll through a foil effect and contacting said suction roll at an angle disposed relative to a tangent of said suction roll at the point of contact;

said doctor slat contact angle being smaller than said doctor blade contact angle;

an angle defined by a first radius extending from the suction roll axis of rotation to the point of contact with said doctor blade and a second radius extending from the suction roll axis of rotation to the point of contact with said doctor slat being in the range of 15 degrees to 70 degrees;

said doctor blade being circumferentially disposed along said suction roll downstream of said doctor slat in a direction of rotation of said suction roll; and a frame spacedly mounting both said doctor blade and said doctor slat;

said frame having a trough formed therein which collects water that has been drawn onto the surface of said suction roll by said doctor slat.

2. The doctoring device of claim 1 wherein said slat holder of the doctor slat is detachably fitted to said frame.

3. The doctoring device of claim 1, wherein said doctor slat is trapezoidal in cross-sectional shape and a base of said doctor slat is in contact with said suction roll.

4. The doctoring device of claim 1, wherein said doctor slat is made of plastic.

* * * * *